US006715773B2

(12) United States Patent
Aiken

(10) Patent No.: US 6,715,773 B2
(45) Date of Patent: Apr. 6, 2004

(54) ADJUSTABLE DAMPING PADS FOR SNOWBOARD BINDINGS

(75) Inventor: Andy J. Aiken, Seattle, WA (US)

(73) Assignee: K-2 Corporation, Vashon Island, WA (US)

( * ) Notice: Subject to any disclaimer, the term of this patent is extended or adjusted under 35 U.S.C. 154(b) by 0 days.

(21) Appl. No.: 09/757,827

(22) Filed: Jan. 9, 2001

(65) Prior Publication Data

US 2002/0089129 A1 Jul. 11, 2002

(51) Int. Cl.[7] ..... A63C 1/24

(52) U.S. Cl. ..... 280/11.14; 280/14.22; 280/623; 280/636; 280/607

(58) Field of Search ..... 280/617, 618, 280/613, 14.22, 14.21, 14.24, 623, 625, 634, 633, 636, 607; 36/117.3

(56) References Cited

U.S. PATENT DOCUMENTS

| | | | | |
|---|---|---|---|---|
| 4,241,929 | A | 12/1980 | Curry | |
| 4,294,460 | A | * 10/1981 | Kirsch | 280/607 |
| 4,316,618 | A | * 2/1982 | Sampson | 280/613 |
| 4,896,895 | A | 1/1990 | Bettosini | |
| 4,979,760 | A | 12/1990 | Derrah | |
| 5,026,086 | A | * 6/1991 | Guers et al. | 280/607 |
| 5,143,395 | A | 9/1992 | Mayr | |
| 5,172,924 | A | 12/1992 | Barci | |
| 5,197,752 | A | * 3/1993 | Engelbert et al. | 280/602 |
| 5,199,734 | A | 4/1993 | Mayr | |
| 5,207,445 | A | * 5/1993 | Hoelzl | 280/607 |
| 5,232,241 | A | 8/1993 | Knott et al. | |
| 5,261,689 | A | 11/1993 | Carpenter et al. | |
| D346,419 | S | 4/1994 | Carpenter | |
| 5,356,170 | A | 10/1994 | Carpenter et al. | |
| 5,367,793 | A | * 11/1994 | Deacon et al. | 36/127 |
| 5,409,244 | A | 4/1995 | Young | |
| 5,417,443 | A | 5/1995 | Blattner et al. | |
| 5,435,080 | A | 7/1995 | Meisleman | |
| 5,446,976 | A | 9/1995 | Donnadieu et al. | |
| 5,454,173 | A | 10/1995 | Falguere et al. | |

(List continued on next page.)

FOREIGN PATENT DOCUMENTS

| | | | | |
|---|---|---|---|---|
| AT | E 87 841 B | 9/1993 | | |
| CH | 000604782 A | * 9/1978 | | 280/618 |
| CH | 000464624 A1 | * 1/1992 | | 280/611 |
| DE | 35 05 255 A1 | 8/1986 | | |
| DE | 198 28 493 A1 | 12/1999 | | |
| DK | 004100327 A1 | * 7/1991 | | 280/607 |
| EP | 0 553 051 A1 | 7/1993 | | |
| EP | 0 612 546 A2 | 8/1994 | | |
| WO | WO 9622136 A | 7/1996 | | |
| WO | WO 00/32285 A1 | 6/2000 | | |

*Primary Examiner*—Brian L. Johnson
*Assistant Examiner*—Kelly E Campbell
(74) *Attorney, Agent, or Firm*—Christensen O'Connor Johnson Kindness PLLC

(57) ABSTRACT

A binding (10) for securing a snowboarder's boot to a snowboard (12). The binding includes a baseplate (16) in which a plurality of apertures (38) are formed. Each aperture receives the base (50) of an adjustable dampening assembly (37). The dampening assembly (37) is retained in place by a flange (54) projecting from the lower extremity of the perimeter of the base, which is captured between the baseplate and the snowboard upper surface. A dampening pad (52) is threadably inserted into an internally threaded aperture formed in the base. The dampening pad can be twisted, either by contacting the upper surface (60) of the dampening pad with a thumb or with a driver tool. Twisting of the dampening pad selectively adjusts the height of the dampening pad, which has an elastomeric head, above the baseplate to adjust the fit and vibration and shock absorption abilities of the binding.

18 Claims, 4 Drawing Sheets

U.S. PATENT DOCUMENTS 5,474,322 A * 12/1995 Perkins et al. ..... 280/613
5,480,176 A 1/1996 Sims
5,503,900 A * 4/1996 Fletcher ..... 428/160
5,505,477 A 4/1996 Turner et al.
5,505,478 A 4/1996 Napoliello
5,520,405 A 5/1996 Bourke
5,520,406 A 5/1996 Anderson et al.
5,577,755 A 11/1996 Metzger et al.
5,609,351 A * 3/1997 Vermillion ..... 280/611
5,667,237 A 9/1997 Lauer
5,704,139 A * 1/1998 Okajima ..... 36/115
5,785,342 A * 7/1998 Bronson ..... 280/602
5,855,390 A 1/1999 Hassell
5,909,894 A * 6/1999 Meader et al. ..... 280/602
5,971,407 A * 10/1999 Zemke et al. ..... 280/14.22
6,010,138 A * 1/2000 Bobrowicz et al. ..... 280/11.36
6,213,493 B1 * 4/2001 Korman ..... 280/14.22
6,328,328 B1 * 12/2001 Finiel ..... 280/636
2002/0093175 A1 * 7/2002 Martin et al. ..... 280/613

* cited by examiner 44
40
40
42
40
40
20
10
24
32
22
37
31
37
28
12
37
16
34
30
37

ADJUSTABLE DAMPING PADS FOR SNOWBOARD BINDINGS

FIELD OF THE INVENTION

The present invention relates to binding interfaces between a rider and a glide board, and more particularly to snowboard bindings that incorporate shock and vibration dampeners.

BACKGROUND OF THE INVENTION

A snowboarder's boots are typically secured to the snowboard by a binding that has one of a variety of overall configurations depending on intended use and rider preferences. Some riders utilize a conventional binding that includes a rear strap that secures over the rider's instep and a forward strap that secures over the ball or toes of the rider's boot. Other riders utilize a step-in binding system, in which engagement members secured on the boot, typically on a lower or side surface of the sole, selectively engages with jaws or catches on the binding. Numerous variations on these arrangements exist, but in each case the snowboard binding includes a frame or base plate that is fastened to the upper surface of the snowboard. Typically screws are utilized that pass through apertures formed in either the snowboard base plate or in a disc that mounts in the center of the base plate to permit rotatable adjustment of the base plate positioning. The screws are threaded into inserts that are molded, adhered or otherwise affixed within the upper surface of the snowboard.

In designing snowboard inserts, several considerations are typically made. The binding should permit the snowboarders boot to be as close as possible to contact with the snowboard, for good control, force transmission and feel. The boot should rest firmly against the binding base plate, without excessive slop that permits the boot to pivot forward and aft relative to the snowboard, again for better control. A predetermined degree of medial and lateral pivoting of the boot relative to the base plate may be permitted, particularly for certain riding styles. Finally, it is often desirable to provide for a degree of vibration dampening and shock absorption between the riders boots and the binding and board. Vibration dampening provides for better control, particularly when riding hard packed surfaces, and shock absorption is particularly beneficial for riding over jumps, half pipes, and other terrain.

In view of these needs, some binding manufacturers have developed bindings that accommodate gasket like elastomeric dampeners disposed between the binding plate and board, to absorb shock and vibration between the binding plate and board. Other manufacturers provide elastomeric dampener pads that mount on an upper surface of the binding plate, to absorb shock and vibration between the base plate and sole of the boot. In some instances, dampener pads are provided that are inserted from below the base plate, through apertures defined in the base plate, before mounting the base plate on the board. The dampener pads project through the apertures a predetermined degree above the upper surface of the base plate.

In such dampened bindings, different thickness pads may be selectively removed and inserted, to change the height of the dampener pad projecting above the base plate, allowing for adjustment of the degree of dampening and to better fit a variety of snowboard boot configurations. However, adjustment requires providing a variety of dampening pads, can only be made by first removing the base plate from the snowboard, and is limited to incremental adjustment as permitted by available dampener pad thicknesses. While adjustment may be made before a rider starts riding, adjustment during a ride may be impracticable due to lack of access to tools, difficulties in handling tools and components while on a snow covered slope, and the need to carry alternate dampener pads. Thus if a rider determines during a ride that excess slop exists between the boot sole and binding, or a different degree of dampening is called for, adjustments typically can not or are not made.

SUMMARY OF THE INVENTION

The present invention provides a snowboard binding for selectively securing a snowboard boot to a snowboard. The binding includes a base plate securable to an upper surface of the snowboard. The binding further includes at least one boot securement member mounted on the base plate. The at least one boot securement member is suitable configured as one or more binding straps, step-in binding catches or jaws, or combination thereof. The binding plate defines at least one dampener mounting aperture. A dampener base is mounted within the dampener mounting aperture of the base plate, and defines a first threaded surface. The binding further includes at least one dampener pad including an elastomeric portion, and defining an upper surface and a second threaded surface threadably engaged with the first threaded surface of the dampener base. The dampener pad is threadably adjustable relative to the dampener base so that the upper surface of the pad projects a selected amount above the base plate.

The present invention thus provides an adjustable dampening system that may be utilized in a snowboard binding to enable the user to selectively adjust the height or disposition of dampening pads without the necessity to remove or loosen the binding from the snowboard. When securing the rider's snowboard boot encased foot to the snowboard binding prior to use, if it is determined that a dampening pad is not suitably contacting the lower surface of the sole of the snowboard boot, or its not sufficiently bearing against the sole of the snowboard boot, a dampening pad or multiple dampening pads can be readily adjusted. The user needs simply to twist the dampening pad within the dampening base, utilizing either the user's thumb or finger, or utilizing a tool such as a screwdriver, depending on the configuration of the present invention. When riding the snowboard, such as down a slope, it may be determined that there is excess slop in the binding, resulting in excessive movement of the boot relative to the board or insufficient shock and vibration happening. When this occurs, adjustment of the binding can be made readily, including on the slope, again without the need to remove the binding from the board. The present invention thus is highly adaptable and readily adjusted.

A further aspect of the present invention provides a snowboard binding for selectively securing a snowboard boot to a snowboard. The binding includes a base plate securable to an upper surface of the snowboard. The binding further includes at least one boot securement member mounted on the base plate. A dampener pad including an elastomeric head portion and a base. The base of the dampener pad is threadably engaged with the threaded dampener mount of the dampener base. The dampener pad is threadably adjustable relative to the dampener base so that the head portion projects a selected amount above the base plate.

A further aspect of the present invention provides a snowboard binding for selectively securing a snowboard boot to a snowboard. The binding includes a base plate securable to an upper surface of the snowboard. The binding further includes at least one boot securement member mounted on the base plate, and a dampener base mounted on the base plate. A dampener pad is adjustably mounted on the dampener base for selective vertical adjustment relative to the dampener base.

A still further aspect of the present invention provides a snowboard binding for selectively securing a snowboard boot to a snowboard. The binding includes a base plate securable to an upper surface of the snowboard. The binding further includes at least one boot securement member mounted on the base plate. A dampener pad is adjustably mounted on the base plate for selective vertical adjustment relative to the dampener base.

A further aspect of the present invention provides a snowboard binding for selectively securing a snowboard boot to a snowboard. The binding includes a base plate securable to an upper surface of the snowboard. The binding further includes at least one boot securement member mounted on the base plate. A dampener base is mounted on the base plat and defines a first threaded surface. A dampener pad includes an elastomeric portion and a second threaded surface that is threadably engaged with the first threaded surface of the dampener base. The dampener pad is threadably adjustable relative to the dampener base, to selectively adjust the position of the elastomeric portion relative to the base plate.

A still further aspect of the present invention provides a snowboard binding for selectively securing a snowboard boot to a snowboard. The binding includes a base plate securable to an upper surface of the snowboard. The binding further includes at least one boot securement member mounted on the base plate. A dampener pad includes an elastomeric portion and a second dampener engagement surface that is engaged with the first dampener engagement surface of the dampener base. The dampener pad is adjustable relative to the base plate to selectively adjust the position of the elastomeric portion relative to the base plate.

A still further aspect of the present invention provides a snowboard binding for selectively securing a snowboard boot to a snowboard. The binding includes a base plate securable to an upper surface of the snowboard. The binding further includes at least one boot securement member mounted on the base plate. A dampener pad includes a second dampener engagement surface that is adjustably engaged with the first dampener engagement surface of the dampener base. The dampener pad is adjustable relative to the base plate to selectively adjust the position of the dampener pad relative to the base plate.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
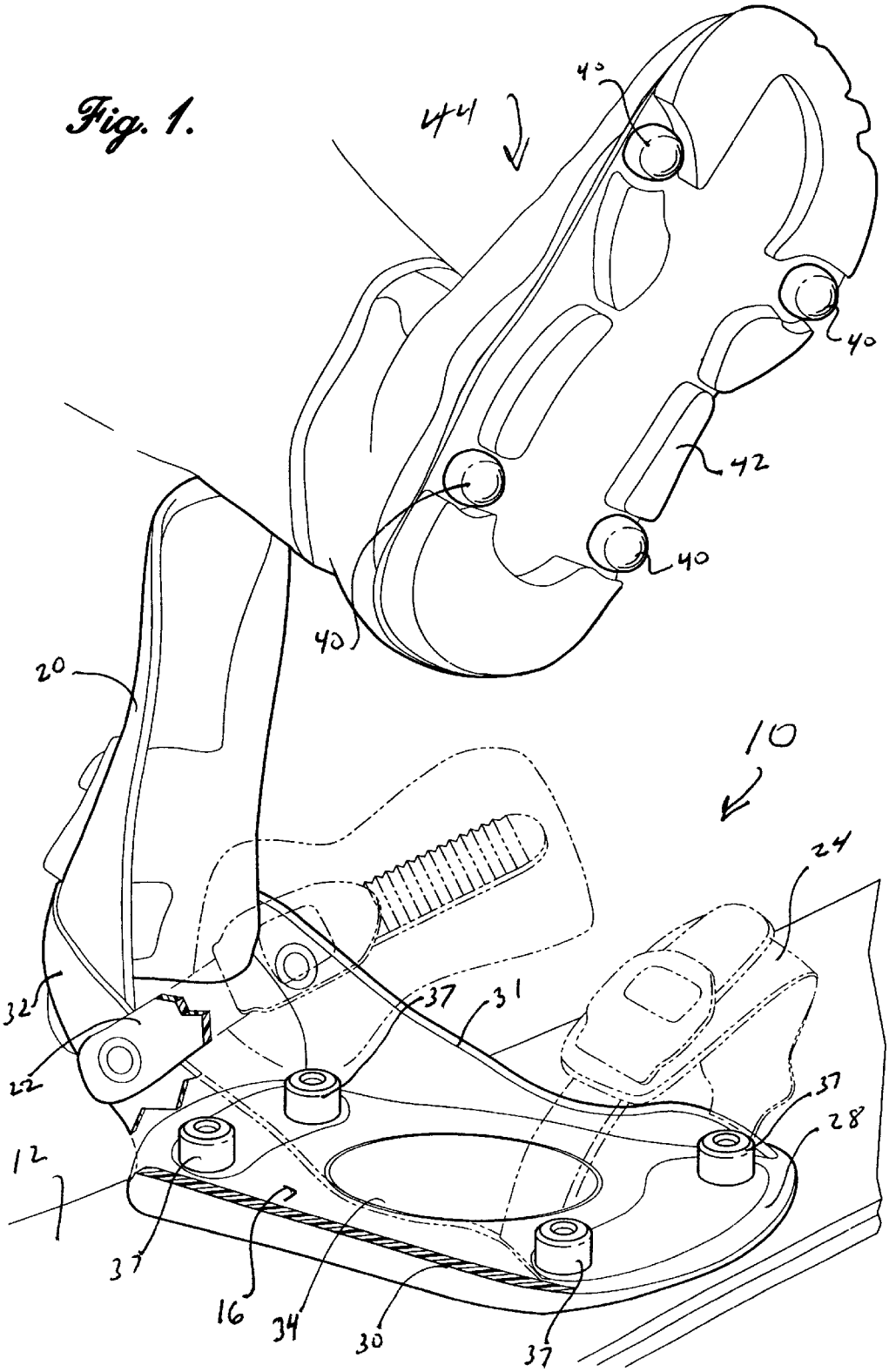
FIG. 1 provides a perspective view of a snowboard binding and boot incorporating a first embodiment of an adjustable dampening pad system constructed in accordance with the present invention.

One suitable embodiment of a snowboard binding 10 constructed in accordance with the present invention is illustrated in FIG. 1. The snowboard binding 10 is of conventional construction, with the exception of including adjustable dampening pads. The snowboard binding 10 is shown mounted to a snowboard 12 through the use of binding inserts (not shown). The binding inserts are molded, adhered, or otherwise mounted within the upper surface of the snowboard, in a standard pattern which enables longitudinal and rotational adjustment of the snowboard binding 10. The snowboard binding 10 includes a baseplate 16, that is secured to the board through the use of a rotodisc (not shown). The binding further includes a highback 20, an ankle strap 22 and a toe strap 24.

The baseplate 16 is the main structural body or frame of the binding 10, and is selectively secured in a desired rotational position on the board through operation of the rotodisc. The rotodisc suitably includes a plurality of slots that extend parallel to each other, and in a predetermined configuration that matches the pattern of inserts on the snowboard. Before describing the adjustable dampening pads, the overall binding construction will first be briefly described.

a. Binding Construction

As with conventional bindings, the binding 10 includes a highback 20 attached at the heel end thereof. The highback 20 limits the rearward movement of the lower leg of the snowboarder in order to provide adequate support in the rearward direction. The ankle strap 22 extends across the binding 10, forward of the highback 20. The ankle strap 22 is positioned above and in front of the ankle area of the snowboarder, and functions to hold the heel of the boot in place on the binding 10. The toe strap 24 secures the forward or toe end of the boot to the binding 10.

The baseplate 16 includes a platform 28, lateral and medial sidewalls 30 and 31, a heel loop 32, and a rotodisc opening 34. The platform 28 extends as a base portion of baseplate 16, and is disposed generally in a plane parallel to the upper surface of the snowboard 12. The platform 28 extends beneath portions of the sole of the snowboard boot. In the illustrated embodiment, the platform 28 is generally rectangular in shape with a circular cutout forming the rotodisc opening 34 in the approximate center thereof. Thus, the platform 28 defines a toe end and heel end on either side of the rotodisc opening 34. The toe end of the platform 28 slopes slightly downwardly toward the toe end of the binding 10, while the lateral sidewall 30 extends upwardly along the side of the platform 28 to form a rail along the lateral side of the snowboard boot to hold the boot in position. The medial sidewall 31 likewise extends upwardly along the medial side of the boot in the binding 10. Ankle and toe straps 22 and 24 are secured to the sidewalls 30 and 31 with fasteners. In the embodiment illustrated, the sidewalls 30 and 31 extend generally perpendicular to the platform 28, with the toe ends of the sidewalls 30 and 31 being approximately uniform in height relative to each other and increasing in height toward the heel end of the platform 28. As the sidewalls 30 and 31 extend rearwardly, they project upwardly to form the heel loop 32 which connects the sidewalls 30 and 31 at the heel end of the binding 10. As sidewalls 30 and 31 extend rearwardly to form the heel loop 32, they rise above and rearward to the platform 28 such that the heel loop 32 forms an opening between the heel loop 32 and the platform 28. Preferably a lower portion of the highback 20 extends around the heel loop 32 adjacent thereto. The rotodisc opening 34 includes a plurality of teeth (not shown) that extend around the rotodisc opening 34 on the platform 28. The teeth are conventional in arrangement, and are adapted to secure the conventional rotodisc, so that the rotodisc may be loosened and the baseplate may be rotatably adjusted.

b. Dampening Assemblies

The binding 10 includes a plurality of adjustable dampening assemblies 37. In order to accommodate these, the platform 28 of the baseplate 16 includes a plurality of receiver apertures 38 (FIGS. 2 and 3) extending therethrough. Each receiver aperture 38 extends entirely through the platform 28. In the embodiment illustrated, the receiver apertures 38 are generally circular in shape. However, the shape of the receiver apertures 38 may be otherwise configured to correspond to the shape of the adjustable dampening assemblies 37, as shall be described subsequently herein.

In the embodiment illustrated, there are four dampening assemblies 37, disposed at the fore and aft corners of the platform 28. Referring to FIG. 1, the four dampening assemblies 38 are aligned with and contact four elastomeric portions 40 defined on the tread 42 of a snowboard base 44. The elastomeric portions 40, which in the illustrated embodiment are cylindrical protrusions, cooperate with the dampening assemblies 37 to form a dampening and shock absorption system.

Figure 2:
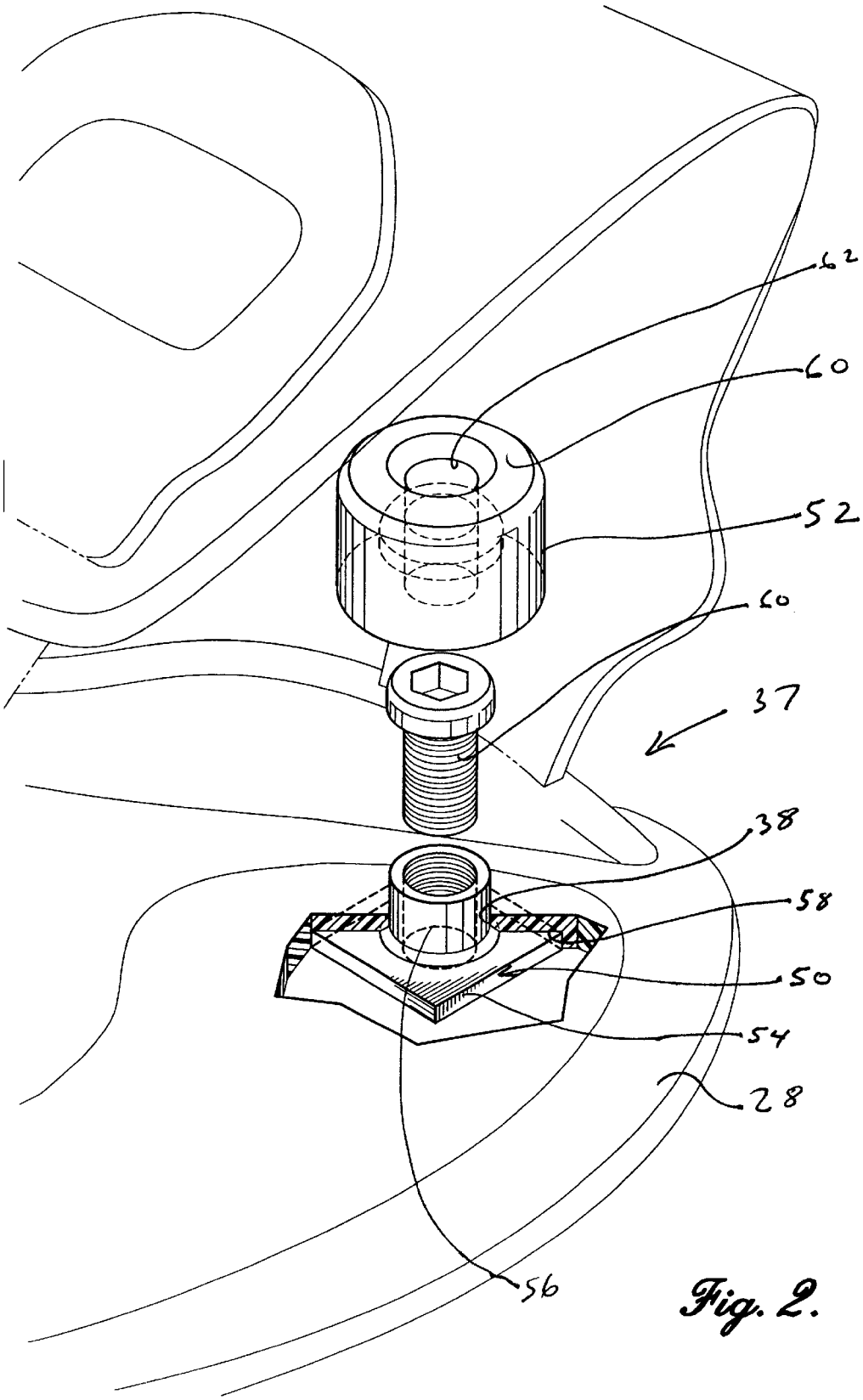
FIG. 2 provides a perspective exploded view of a driver adjustable dampening pad included in the embodiment of FIG. 1 with a portion of the base plate removed for clarity.

Referring to FIG. 2, each adjustable dampening assembly 37 includes a base 50 and an elastomeric dampening pad 52. The base 50 includes a base flange 54 and an internally threaded collar 56 projecting orthogonally upward from the center of the base flange 54. A recess 58 is formed in the lower surface of the platform 28 of the base plate 16. The recess 58 matches the shape of the base flange 54 of the base 50, and has a depth equal to the thickness of the base flange 54. The base 50 is inserted into the platform 28 from the lower side, with the collar 56 projecting upwardly through the aperture 38, and the base flange 54 being received within the recess 58. The collar 56 thus projects vertically upward through the platform 28. The base flange 54 is securely captured between the platform 28 and the snowboard 12, to retain the adjustable dampening assembly 37 in position.

The dampening pad 52 is suitably formed from an elastomeric material that is capable of absorption of shock and vibration, as well as for frictional contact with the snowboard boot. The durometer hardness of the dampening pad 52 may be selected for a desired degree of dampening. Multiple dampening pads 52 of differing durometer hardness may be provided in a kit, so that a user may completely replace one dampening pad 52 with alternate dampening pads for either a greater degree of dampening, lesser degree of dampening, or to provide a greater total height. The dampening pad 52 is adhered, such as by overmolding, onto the head of a threaded fastener 60. To assemble the assembly 37, the fastener 60, on which the dampening pad 52 is mounted, is threaded into the threaded collar 56 of the base 50. The vertical position of the dampening pad 52 is selectively adjusted, so that it extends a predetermined desired degree in height above the upper surface of the platform 28 of the baseplate 16, i.e., in the vertical direction defined orthogonal to the platform 28 to the baseplate 16.

Figure 3:
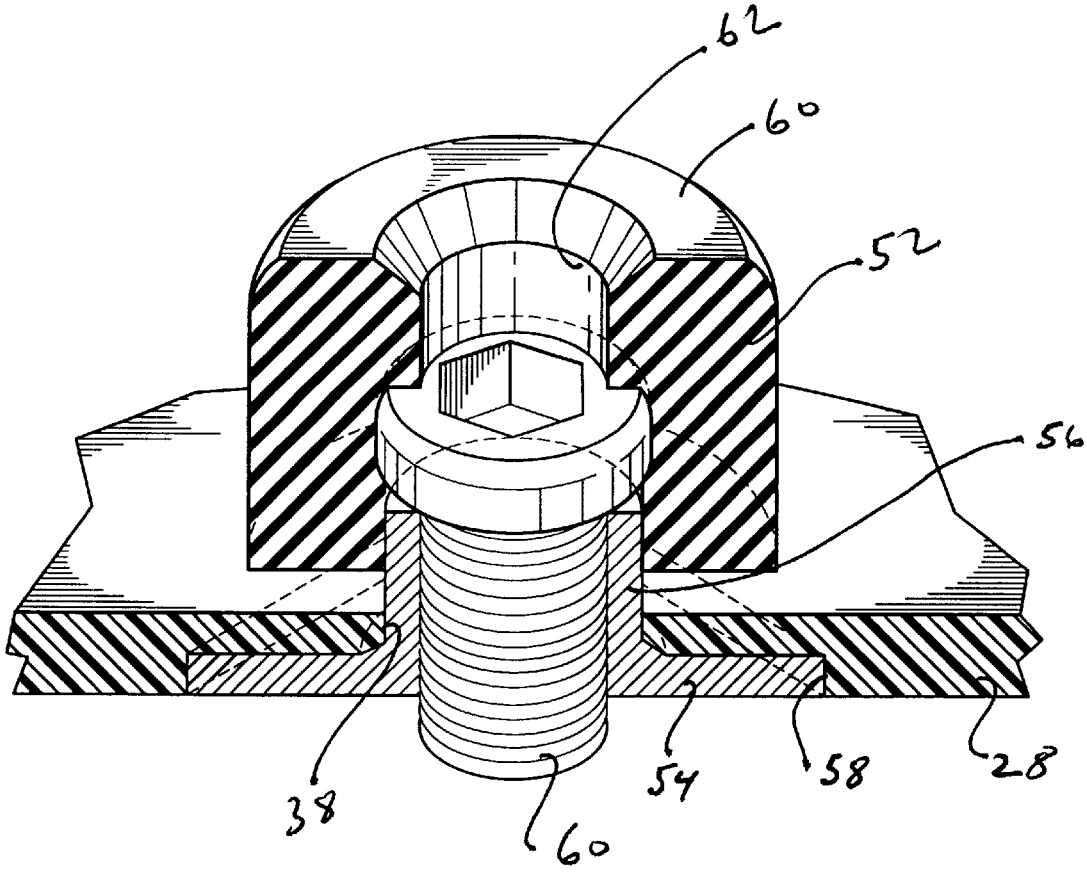
FIG. 3 provides a perspective cross sectional view of the adjustable dampening pad of FIG. 2.

The upper surface 60 or head of the dampening pad 52 may be suitably contoured or textured so as to provide for a sure contact between a user's thumb or finger and the dampening pad 52, for twisting or rotatable adjustment. For example, a plurality of raised concentric ridges is formed on the upper surface of the dampening pad to provide a good grip. A user bears down on the dampening pad upper surface 60 with a thumb or finger, and presses to twist clockwise to lower the dampening pad, or counterclockwise to raise the dampening pad. Alternately, as shown in FIGS. 2 and 3, a central recess 62 may be formed in the pad 52 for access to the keyed head of the fastener 60, for adjustment using a driver tool. This adjustment can be made readily prior to use, or during use, without any need to remove or loosen the binding 10 from the snowboard 12. Multiple dampening pads can be adjusted to differing heights, so that the contact and degree of dampening provided by the various pads 52 included in the dampening assemblies 37 can vary about different locations of the board to custom fit a boot to the binding and the performance requirements of the individual user.

The dampening pad 52 is suitably formed of an elastomer construction for vibration and shock absorption and dampening. Depending on the degree of resiliency required, if a fairly stiff elastomeric or rubbery material is utilized, the externally threaded surface 58 and the upper surface 60 may be integrally formed of an elastomeric material. However, if a softer durometer elastomeric head 60 is desired to increase dampening, then the dampening pad 52 may include a substantially rigid externally threaded sleeve that is capped with an elastomeric head 60, so as to present an upper elastomeric construction while still being capable of being firmly threadably secured.

Figure 4:
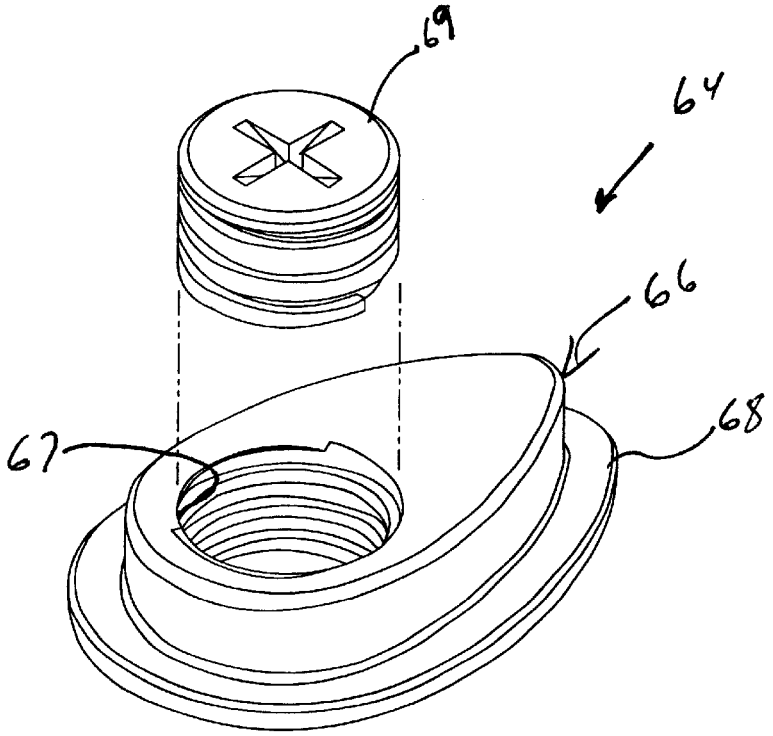
FIG. 4 provides a perspective view of an alternate driver adjustable dampening pad of the present invention.

An alternate embodiment of an adjustable dampener assembly 64 constructed in accordance with the present invention is shown as FIG. 4. This adjustable dampener assembly 64 is similar to the previously-described adjustable dampener assembly 37. The adjustable dampener assembly 64 thus includes a base 66 including a base flange 68 and a dampening pad 69. In the embodiment illustrated in FIG. 4, the base has an ovoid shape to fit within an ovoid recess in the platform 28. The base 66 includes an internally threaded central recess 67, into which the dampening pad 69 is threaded. For this purpose, the dampening pad 69 defines an externally threaded surface, rather than including an integrated fastener, as in the previously disclosed embodiment. In the embodiment illustrated, the dampening pad 69 is thus formed of a fairly stiff elastomer material. The base 66 may also be formed from a fairly stiff elastomer, or otherwise may be formed of a rigid material such as a metal, or a thermosetting or thermoplastic polymer. The dampening pad 69 includes an upper surface that is contoured to define a keyed recess which accommodates and receives a similarly keyed tool. In the embodiment illustrated, the keyed surface is an "x" shaped recess that receives the tip of a Phillips type screwdriver for adjustment. Other keyed constructions are possible, such as a hexagonal keyed construction, or a slotted construction.

Figure 5:
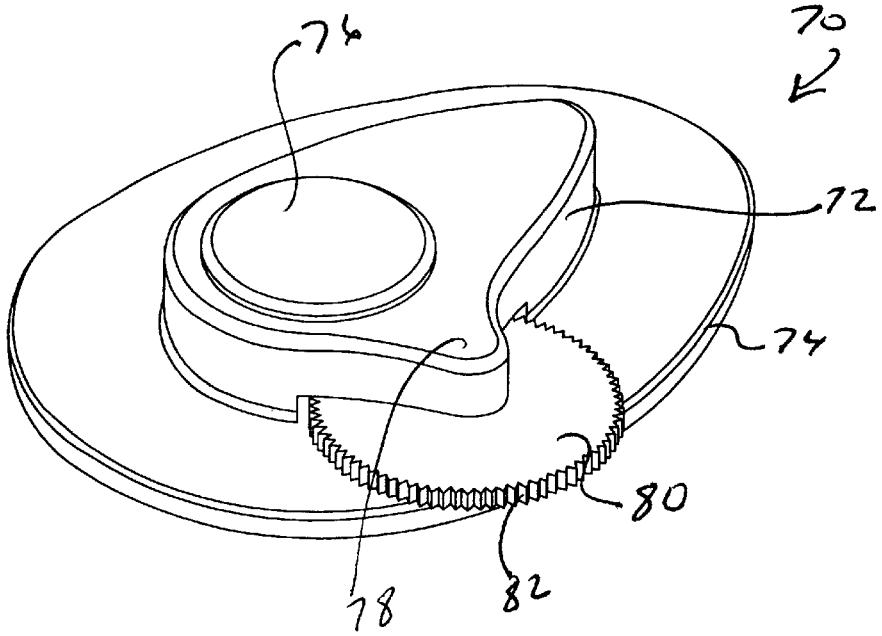
FIG. 5 provides a perspective view of a further alternate embodiment of a thumb wheel adjustable dampening pad of the present invention.

A still alternate embodiment is illustrated in FIG. 5. FIG. 5 illustrates an adjustable dampening pad 70 that again includes a base 72 defining a base flange 74, and having an internally threaded recess that receives a height adjustable dampening pad 76. However, the base 72 includes a lateral extension 78 projecting from one side thereof. A slot is defined between the extension 78 and the base flange 74. This slot accommodates and receives one side and a central portion of a thumb wheel 80. The thumb wheel 80 is pinned on a central axis between the extension 78 and the base 74 on a pin (not shown) so that it can be rotated. The thumb wheel 80 defines an externally toothed perimeter 82. The toothed perimeter 82 and the thumb wheel 80 engages a correspondingly toothed lower surface 84 (not shown) on a central post (not shown) of an extending downwardly from the dampening pad 76. The upper end of the post is externally threaded and is received within an internally threaded central passage of the dampening pad 76. When the thumb wheel 80 is turned, the teeth 82 on the thumb wheel 80 turn on the toothed surface of the central post, which then threadedly advances the dampening pad 76 upwardly or downwardly. With this construction, the dampening pad 76 is keyed so that it is nonrotatably received within the aperture of the base 72. Alternate configurations are possible, such as a post having a spiral or worm gear type surface, so that the entire post and dampening pad 76 rotate and adjust upwardly and downwardly when the thumb wheel is contacted and rotated by the user. In order to accommodate the thumb wheel 80, a recess is formed in the platform 28 of the baseplate 16, with sufficient clearance being provided for the user to fit a finger to contact and move the thumb wheel 80. Preferably, the recess is defined near an edge of the platform 28, so that the thumb wheel 80 projects beyond the sole of the boot for adjustment even when the boot is mounted on the binding.

The present invention has been illustrated and described with a plurality of adjustable dampener pads mounted on each of the forward and rear ends of the base plate. It should be readily apparent that numerous other configurations are possible. More or fewer adjustable dampeners may be utilized. Adjustable dampeners may be mixed with nonadjustable dampeners. Adjustable dampeners may be provided only forwardly, rearwardly, centrally, on lateral and/or medial sides, or in combinations thereof. The dampeners have been illustrated above as each being mounted on a separate base. They may alternately be mounted on a single base carrying multiple dampeners. Rather than being mounted within base plate apertures, the dampeners may instead be mounted in other fashions, such as by being adhered, screwed or riveted directly onto the upper surface of the base plate or within recesses defined therein. Further, rather than being threaded onto a base, an adjustable dampener may be threaded directly into a threaded aperture in the base plate, or onto a threaded stud or internally threaded collar projecting upwardly from the base plate.

While the preferred embodiments of the adjustable dampener pads described above and illustrated herein have been shown used on snowboard bindings including boot securement straps, it should be readily evident that the invention is equally applicable to use on other types of bindings, such as step-in bindings. One suitable but non-limiting example of a step-in binding with which the present invention may be used is the CLICKER tm binding sold by K-2 Corporation, Vashon Island, Wash. Such step in bindings are more fully described in U.S. Pat. No. 5,690,350 to Turner, hereby expressly incorporated by reference herein.

Likewise, while the binding illustrated includes a highback, the adjustable dampener pads of the present invention may also be used with bindings that do not include highbacks, which are intended for use with boots including integral external or internal highback support. Similarly, use of the adjustable dampener pads of the present invention is not limited to bindings including rotary discs for adjustable positioning of the baseplate, and thus may be used with stationary or otherwise adjustable base plates or frames.

The present invention has been described thus far with reference to elastomeric dampeners. Other types of dampeners, including dampeners with integrated springs or hydraulic fluid dampening may alternately be used.

The present invention has been described and illustrated with respect to vertical adjustment of the dampener pad. Adjustment in other orientations is also within the scope of the present invention. For example, by arranging the screw thread adjustment mechanism to move along a horizontal axis, dampener pad position in the forward and aft, or lateral and medial, directions may be provided in accordance with the present invention.

The adjustment mechanisms described and illustrated above utilize screw threads. Other types of adjustments may be utilized. For example, a spring biased ratchet mechanism, rotatable to a first position for longitudinal adjustment opposed by spring force, and routable to a second position to engage in a ratchet detent, may be employed. As a further example, other rotary to linear adjustment mechanisms may be used in place of a threaded adjustment, such as a cam and spiral contoured follower may be incorporated, as permitted by space constraints.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snowboard binding for selectively securing a snowboard boot to a snowboard, comprising:

a base plate securable to an upper surface of the snowboard and defining at least one dampener mounting aperture;

at least one boot securement member mounted on the base plate;

a dampener base mounted within the dampener mounting aperture of the base plate, and defining a first threaded surface; and a dampener pad including an elastomeric portion and defining an upper surface and a second threaded surface threadably engaged with the first threaded surface of the dampener base, the dampener pad being threadably adjustable relative to the dampener base so that the upper surface of the pad projects a selected amount above the base plate.

2. The snowboard binding of claim 1, wherein the dampener pad includes an elastomeric head.

3. The snowboard binding of claim 1, wherein the base plate defines a plurality of dampener mounting apertures, further comprising a plurality of dampener bases mounted in corresponding apertures and a plurality of dampener pads adjustably mounted on the dampener bases.

4. The snowboard binding of claim 1, wherein the dampener pad defines an externally threaded stud that is threadedly engaged with an internally threaded surface of the dampener base.

5. The snowboard binding of claim 1, wherein the dampener pad is constructed to enable adjustment by a user bearing on the upper surface of the dampener pad and applying a twisting force.

6. The snowboard binding of claim 5, wherein the upper surface of the dampener pad is contoured to facilitate twisting with a thumb or finger.

7. The snowboard binding of claim 5, wherein the upper surface of the dampener pad includes a keyed surface that is engageable with a correspondingly keyed drive tool for rotary adjustment.

8. The snowboard binding of claim 1, further comprising an adjustment wheel rotatably mounted on the dampener base, the adjustment wheel defining a toothed perimeter that engages the dampener pad to linearly advance the dampener pad relative to the dampener base upon rotation of the adjustment wheel, at least an edge portion of the adjustment wheel being exposed for access to manually adjust the dampener pad.

9. The snowboard binding of claim 1, wherein the dampener base defines an outer perimeter dimensioned to closely fit within the aperture of the base plate, and a flange projecting about a lower edge of the perimeter to be captured between the base plate and the snowboard.

10. The snowboard binding of claim 1, wherein the at least one boot securement member comprises at least one strap that is selectively fastenable over a boot of the snowboarder.

11. A snowboard binding for selectively securing a snowboard boot to a snowboard, comprising:

a base plate securable to an upper surface of the snowboard and provided with a threaded dampener mount;

at least one boot securement member mounted on the base plate; and a dampener pad including an elastomeric head portion and a base that is threadably engaged with the threaded dampener mount of the base plate, the dampener pad being threadably adjustable relative to the base plate so that the head portion projects a selected amount above the base plate.

12. A snowboard binding for selectively securing a snowboard boot to a snowboard, comprising:

a base plate securable to an upper surface of the snowboard, the base plate defining a toe end and a heel end;

at least one boot securement member mounted on the base plate;

a dampener base mounted to the base plate; and a plurality of dampener pads adjustably mounted to the toe end or the heel end of the dampener base for selective vertical adjustment relative to the dampener base so that the dampener pads project a selective amount above the base plate.

13. A snowboard binding for selectively securing a snowboard boot to a snowboard, comprising:

a base plate securable to an upper surface of the snowboard, the base plate defining a toe end and a heel end;

at least one boot securement member mounted on the base plate; and a plurality of dampener pads adjustably mounted to the toe end or the heel end of the base plate for selective vertical adjustment relative to the base plate so that the dampener pads project a selective amount above the base plate.

14. A snowboard binding for selectively securing a snowboard boot to a snowboard, comprising:

a base plate securable to an upper surface of the snowboard;

at least one boot securement member mounted on the base plate;

a dampener base mounted on the base plate and defining a first threaded surface; and a dampener pad including an elastomeric portion and a second threaded surface threadably engaged with the first threaded surface of the dampener base, the dampener pad being selectively threadably adjustable relative to the dampener base to adjust the position of the elastomeric portion above the base plate.

15. A snowboard binding for selectively securing a snowboard boot to a snowboard, comprising:

a base plate securable to an upper surface of the snowboard and defining a first dampener engagement surface;

at least one boot securement member mounted on the base plate; and a dampener pad including an elastomeric portion and a second dampener engagement surface adjustably engaged with the first dampener engagement surface of the base plate, the dampener pad being adjustable relative to the base plate to selectively adjust the position of the elastomeric portion above the base plate.

16. A snowboard binding for selectively securing a snowboard boot to a snowboard, comprising:

a base plate securable to an upper surface of the snowboard and defining a first dampener engagement surface;

at least one boot securement member mounted on the base plate; and a dampener pad including a second dampener engagement surface adjustably engaged with the first dampener engagement surface of the base plate, the dampener pad being adjustable relative to the base plate to selectively adjust the position of the dampener pad above the base plate.

17. A snowboard binding for selectively securing a snowboard boot to a snowboard, comprising:

a base member securable to an upper surface of the snowboard, the base member defining a toe end and a heel end;

at least one boot securement member mounted on the base member;

at least two dampener bases mounted to the base member at the toe end or the heel end thereof; and at least two dampener pads adjustably mounted to the dampener bases, respectively, for selectively adjusting the positioning of the dampener pads relative to the base member, wherein the dampener pads are positioned such that the dampener pads contact the snowboard boot when the snowboard boot is secured to the snowboard.

18. A snowboard binding for selectively securing a snowboard boot to a snowboard, comprising:

a base securable to an upper surface of the snowboard, the base defining a toe end and a heel end;

at least one boot securement member mounted on the base; and at least two dampener pads adjustably mounted to the toe end or the heel end of the base for selective adjustment relative to the base, wherein the dampener pads are positioned such that the dampener pads contact the snowboard boot when the snowboard boot is secured to the snowboard.

* * * * *